US007540832B2

(12) United States Patent
Krull

(10) Patent No.: US 7,540,832 B2
(45) **Date of Patent: *Jun. 2, 2009**

(54) EXERCISE WEIGHT STACK METHODS AND APPARATUS

(75) Inventor: Mark A. Krull, Bend, OR (US)

(73) Assignee: Nautilus, Inc., Vancouver, WA (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/742,281

(22) Filed: Apr. 30, 2007

(65) Prior Publication Data

US 2007/0203001 A1 Aug. 30, 2007

Related U.S. Application Data

(63) Continuation of application No. 11/301,395, filed on Dec. 13, 2005.

(60) Provisional application No. 60/635,884, filed on Dec. 14, 2004.

(51) Int. Cl.
*A63B 21/062* (2006.01)

(52) U.S. Cl. ..... 482/98; 482/99

(58) Field of Classification Search ..... 482/92–94, 482/97–103

See application file for complete search history.

(56) References Cited

U.S. PATENT DOCUMENTS

| | | | |
|---|---|---|---|
| 772,906 | A | 10/1904 | Reach |
| 848,272 | A | 3/1907 | Thornley |
| 1,053,109 | A | 2/1913 | Reach |
| 1,779,594 | A | 10/1930 | Hall |
| 3,647,209 | A | 3/1972 | La Lanne |

(Continued)

FOREIGN PATENT DOCUMENTS

| | | | |
|---|---|---|---|
| CN | 2430184 | Y | 5/2001 |

(Continued)

OTHER PUBLICATIONS

Nautilus Home Health & Fitness Catalog, catalog, Nautilus, Inc., pp. 1-56 (2004).

(Continued)

*Primary Examiner*—Loan H Thanh
*Assistant Examiner*—Victor K Hwang
(74) *Attorney, Agent, or Firm*—Dorsey & Whitney LLP

(57) ABSTRACT

An exercise device including one or more weight stacks moveably supported on a frame. Each weight stack includes one or more weight plates that may be selectively engaged by way of a dial arrangement operably coupled with the weight stack. The dial arrangement is connected with a selection member that extends through a selection aperture in the weight plates. Each selection aperture defines a unique contour with at least one engaging surface, such as a tab. The selection member has corresponding protrusions adapted to engage the engaging surface of the weight plate. Each dial arrangement may be configured so that the weight stack may only be actuated when the selection member is properly positioned so that the protrusions properly engage the engaging surfaces. By adjusting the dial setting, the selection member is rotated so that one or more of the various protrusions engage associated engaging surfaces in order to engage some combination of weight plates. Upon actuation (i.e., exercise), the selected weights are engaged and moved when the selection member is properly orientated.

18 Claims, 8 Drawing Sheets

U.S. PATENT DOCUMENTS 3,807,728 A * 4/1974 Chillier ..... 482/101
3,912,261 A 10/1975 Lambert, Sr.
3,971,555 A 7/1976 Mahnke
4,200,280 A 4/1980 Goodwin
4,339,125 A 7/1982 Uyeda et al.
4,349,192 A 9/1982 Lambert, Jr. et al.
RE31,113 E 12/1982 Coker et al.
4,453,710 A 6/1984 Plötz
4,529,198 A 7/1985 Hettick, Jr.
4,538,805 A 9/1985 Parviainen
4,540,171 A 9/1985 Clark et al.
4,546,970 A 10/1985 Mahnke
4,546,971 A 10/1985 Raasoch
4,568,078 A 2/1986 Weiss
4,601,466 A 7/1986 Lais
4,624,457 A 11/1986 Silberman et al.
4,627,615 A 12/1986 Nurkowski
4,712,793 A 12/1987 Harwick et al.
4,744,559 A 5/1988 Mahnke et al.
4,809,973 A 3/1989 Johns
4,822,034 A 4/1989 Shields
4,834,365 A 5/1989 Jones
4,878,662 A 11/1989 Chern
4,878,663 A 11/1989 Luquette
4,971,305 A 11/1990 Rennex
4,982,957 A 1/1991 Shields
5,000,446 A 3/1991 Sarno
5,037,089 A 8/1991 Spagnuolo et al.
5,123,885 A 6/1992 Shields
5,135,453 A 8/1992 Sollenberger
5,263,915 A 11/1993 Habing
5,306,221 A 4/1994 Itaru
5,374,229 A 12/1994 Sencil
5,556,362 A 9/1996 Whipps
5,669,861 A 9/1997 Toups
5,776,040 A 7/1998 Webb et al.
5,839,997 A 11/1998 Roth et al.
5,876,313 A 3/1999 Krull
6,033,350 A 3/2000 Krull
6,083,144 A 7/2000 Towley, III et al.
6,117,049 A * 9/2000 Lowe ..... 482/4
6,149,558 A 11/2000 Chen
6,174,265 B1 1/2001 Alessandri
6,186,927 B1 2/2001 Krull
6,186,928 B1 2/2001 Chen
6,193,635 B1 2/2001 Webber et al.
6,196,952 B1 3/2001 Chen
6,261,022 B1 7/2001 Dalebout et al.
6,394,935 B1 5/2002 Lake
6,402,666 B2 6/2002 Krull
6,416,446 B1 7/2002 Krull
6,422,979 B1 7/2002 Krull
6,436,013 B1 8/2002 Krull
6,447,430 B1 9/2002 Webb et al.
6,500,101 B1 12/2002 Chen
6,540,650 B1 4/2003 Krull
6,551,223 B2 4/2003 Cheng
6,582,345 B2 6/2003 Roy
6,595,902 B1 7/2003 Savage et al.
6,669,606 B2 12/2003 Krull
6,719,672 B1 4/2004 Ellis et al.
6,719,674 B2 4/2004 Krull
6,733,424 B2 5/2004 Krull
6,746,381 B2 6/2004 Krull
6,749,547 B2 6/2004 Krull
6,814,708 B1 11/2004 Jennings
D500,820 S 1/2005 Krull
D536,752 S 2/2005 Walkerdine
6,855,097 B2 2/2005 Krull
6,902,516 B2 6/2005 Krull
D508,628 S 8/2005 Crawford et al.
6,974,405 B2 12/2005 Krull
7,077,790 B1 7/2006 Krull
7,077,791 B2 7/2006 Krull
D528,173 S 9/2006 Flick et al.
D528,611 S 9/2006 Flick et al.
7,121,988 B2 10/2006 Walkerdine
7,153,243 B1 12/2006 Krull
D540,405 S 4/2007 Crawford et al.
D540,894 S 4/2007 Crawford et al.
7,252,627 B2 8/2007 Carter
7,261,678 B2 8/2007 Crawford et al.
2002/0025888 A1 * 2/2002 Germanton et al. ..... 482/1
2003/0092542 A1 5/2003 Bartholomew et al.
2003/0148862 A1 8/2003 Chen et al.
2004/0005968 A1 1/2004 Crawford et al.
2004/0005969 A1 1/2004 Chen
2004/0023765 A1 2/2004 Krull
2004/0072661 A1 4/2004 Krull
2005/0143228 A1 * 6/2005 Lee ..... 482/94
2005/0176559 A1 8/2005 Carter
2006/0025287 A1 2/2006 Chermack
2006/0105889 A1 5/2006 Webb
2006/0135328 A1 6/2006 Doudiet
2006/0205571 A1 9/2006 Krull
2006/0211550 A1 9/2006 Crawford et al.
2006/0217245 A1 9/2006 Golesh et al.
2006/0223684 A1 10/2006 Krull
2008/0039299 A1 2/2008 Crawford et al.

FOREIGN PATENT DOCUMENTS

DE 33 32 150 A1 3/1985
DE 278 064 A1 * 4/1990
EP 177643 A1 4/1986
EP 1 614 450 A1 1/2006
FR 2613237 A1 10/1988
JP 10118222 5/1998
RU 1780780 A1 12/1992
SE 455 573 B * 7/1988
SU 1389789 A2 4/1988
SU 1643024 A1 4/1991
TW 454523 Y 2/2002
WO WO 2006/008767 A1 1/2006

OTHER PUBLICATIONS

Office Action Summary and Detailed Action, U.S. Appl. No. 08/886,607, mailed Apr. 30, 1998, 5 pages.
Response, U.S. Appl. No. 08/886,607, dated May 20, 1998, 2 pages.
Office Action Summary, Detailed Action, and PTO-892, U.S. Appl. No. 08/886,607, mailed Aug. 17, 1998, 11 pages.
Interview Summary, U.S. Appl. No. 08/886,607, mailed Oct. 29, 1998, 5 pages.
Amendment and Response and red-lined drawing sheets, U.S. Appl. No. 08/886,607, dated Nov. 4, 1998, 18 pages.
Notice of Allowance and Notice of Allowability, U.S. Appl. No. 08/886,607, mailed Nov. 23, 1998, 2 pages.
Preliminary Amendment, U.S. Appl. No. 09/259,732, dated Mar. 1, 1999, 5 pages.
Office Action and PTO-892, U.S. Appl. No. 09/259,732, mailed Jul. 12, 1999, 9 pages.
Amendment and Response, U.S. Appl. No. 09/259,732, dated Oct. 6, 1999, 8 pages.
Office Action and PTO-892, U.S. Appl. No. 09/259,732, mailed Jan. 6, 2000, 8 pages.
Amendment and Response, U.S. Appl. No. 09/259,732, dated Apr. 6, 2000, 9 pages.
Office Action, U.S. Appl. No. 09/259,732, mailed Jul. 5, 2000, 7 pages.
Amendment and Response to Final Office Action Rejection, U.S. Appl. No. 09/259,732, dated Aug. 28, 2000, 3 pages.
Terminal Disclaimer, U.S. Appl. No. 09/259,732, dated Aug. 28, 2000, 1 page.

Notice of Allowance, Notice of Allowability, Examiner's Amendment, and Interview Summary, U.S. Appl. No. 09/259,732, mailed Sep. 18, 2000, 4 pages.
Office Action, U.S. Appl. No. 09/300,546, mailed Sep. 29, 2000, 5 pages.
Amendment and Response, U.S. Appl. No. 09/300,546, dated Oct. 30, 2000, 3 pages.
Office Action and PTO-892, U.S. Appl. No. 09/300,546, mailed Feb. 20, 2001, 8 pages.
Amendment and Response, U.S. Appl. No. 09/300,546, dated May 21, 2001, 8 pages.
Office Communication, U.S. Appl. No. 09/300,546, mailed May 31, 2001, 2 pages.
Substitute Amendment and Response, U.S. Appl. No. 09/300,546, dated Jun. 26, 2001, 3 pages.
Office Action, U.S. Appl. No. 09/300,546, mailed Sep. 11, 2001, 5 pages.
Amendment and Response to Final Rejection, U.S. Appl. No. 09/300,546, dated Nov. 15, 2001, 4 pages.
Terminal Disclaimer, U.S. Appl. No. 09/300,546, dated Nov. 15, 2001, 1 page.
Notice of Allowance, Notice of Allowability, and Examiner's Amendment, U.S. Appl. No. 09/300,546, mailed Feb. 14, 2002, 4 pages.
Office Action, U.S. Appl. No. 09/745,822, mailed Sep. 10, 2002, 4 pages.
Amendment and Response, U.S. Appl. No. 09/745,822, dated Oct. 10, 2002, 6 pages.
Office Action and PTO-892, U.S. Appl. No. 09/745,822, mailed Jan. 2, 2003, 9 pages.
Amendment and Response and Terminal Disclaimer, U.S. Appl. No. 09/745,822, dated Apr. 30, 2003, 14 pages.
Notice of Allowance, Notice of Allowability, and Detailed Action, U.S. Appl. No. 09/745,822, mailed Jul. 29, 2003, 4 pages.
Office Action and PTO-892, U.S. Appl. No. 10/867,834, mailed Jul. 14, 2005, 7 pages.
Amendment and Response, U.S. Appl. No. 10/867,834, dated Nov. 14, 2005, 10 pages.
Office Action, U.S. Appl. No. 10/867,834, mailed Feb. 7, 2006, 7 pages.
Response After Final Rejection and Terminal Disclaimer, U.S. Appl. No. 10/867,834, dated Jun. 6, 2006, 3 pages.
Notice of Allowance and Notice of Allowability, U.S. Appl. No. 10/867,834, mailed Jun. 22, 2006, 2 pages.
Office Action and PTO-892, U.S. Appl. No. 11/377,718, mailed Aug. 3, 2007, 10 pages.
Amendment and Response to Office Action, U.S. Appl. No. 11/377,718, dated Nov. 5, 2007, 12 pages.
Non-Final Office Action, Office Action Summary, Detailed Action, and PTO-892, U.S. Appl. No. 10/127,049, mailed Oct. 4, 2004, 5 pages.
Amendment and Response, U.S. Appl. No. 10/127,049, dated Apr. 4, 2005, 5 pages.
Terminal Disclaimer, U.S. Appl. No. 10/127,049, dated Apr. 4, 2005, 1 page.
Notice of Allowance, Notice of Allowability, and Detailed Action, U.S. Appl. No. 10/127,049, mailed Jun. 24, 2005, 10 pages.
Notice of Allowance, Notice of Allowability, and Detailed Action, U.S. Appl. No. 10/127,049, mailed Mar. 7, 2006, 9 pages.
Office Action and PTO-892, U.S. Appl. No. 11/301,395, mailed Jul. 7, 2006, 7 pages.
Amendment and Response to Office Action , annotated drawing sheet 2/8, and replacement drawing sheet 2/8, U.S. Appl. No. 10/301,395, dated Jan. 8, 2007, 15 pages.
Office Action, U.S. Appl. No. 11/301,395, mailed Feb. 9, 2007, 7 pages.
Amendment and Response to Final Office Action, U.S. Appl. No. 11/301,395, dated Apr. 9, 2007, 9 pages.
Notice of Allowance and Notice of Allowability, U.S. Appl. No. 11/301,395, mailed May 3, 2007, 2 pages.
Office Action and PTO-892, U.S. Appl. No. 11/301,395, dated Sep. 27, 2007, 6 pages.
Amendment and Response to Office Action, U.S. Appl. No. 11/301,395, mailed Jan. 28, 2008, 6 pages.
U.S. Appl. No. 29/278,771, filed Apr. 9, 2007, Crawford et al., Pending.
U.S. Appl. No. 29/278,785, filed Apr. 10, 2007, Crawford et al., Pending.
U.S. Appl. No. 29/278,953, filed Apr. 16, 2007, Crawford et al., Pending.
U.S. Appl. No. 11/867,643, filed Oct. 4, 2007, Webb, G., Pending.
U.S. Appl. No. 29/302,698, filed Jan. 23, 2008, Gettle, Pending.
U.S. Appl. No. 29/302,699, filed Jan. 23, 2008, Golesh et al., Pending.
U.S. Appl. No. 29/302,700, filed Jan. 23, 2008, Golesh et al., Pending.
U.S. Appl. No. 29/302,708, filed Jan. 23, 2008, Golesh et al., Pending.
Office Action and PTO-892, U.S. Appl. No. 11/301,395, mailed Jul. 7, 2006, 8 pages.
Amendment and Response to Office Action, annotated drawing sheet 2/8, and replacement drawing sheet 2/8, U.S. Appl. No. 11/301,395, mailed Jan. 8, 2007, 15 pages.
Final Office Action, U.S. Appl. No. 11/301,395, mailed Feb. 9, 2007, 7 pages.
Amendment and Response to Final Office Action, U.S. Appl. No. 11/301,395, dated Apr. 9, 2007, 9 pages.
Notice of Allowance, U.S. Appl. No. 11/301,395, mailed May 3, 2007, 2 pages.
Office Action and PTO-892, U.S. Appl. No. 11/301,395, mailed Sep. 27, 2007, 6 pages.
Amendment and Response to Office Action, U.S. Appl. No. 11/301,395, dated Jan. 28, 2008, 6 pages.
Non-Final Office Action and PTO-892, U.S. Appl. No. 11/301,395, mailed Jun. 10, 2008, 10 pages.
Amendment and Response to Office Action, annotated drawing sheet 1/8 (Fig. 1), and replacement drawing sheet 1/8 (Fig. 1), U.S. Appl. No. 11/301,395, dated Oct. 10, 2008.
Final Office Action, U.S. Appl. No. 11/377,718, mailed Feb. 29, 2008, 13 pages.
Amendment and Response to Final Office Action, U.S. Appl. No. 11/377,718, dated May 30, 2008, 10 pages.
Non-Final Office Action and PTO-892, U.S. Appl. No. 11/377,718, mailed Jun. 25, 2008, 15 pages.
U.S. Appl. No. 12/142,904, filed Jun. 20, 2008, Webb, Pending.

* cited by examiner

EXERCISE WEIGHT STACK METHODS AND APPARATUS

CROSS-REFERENCE TO RELATED APPLICATIONS

The present application is a continuation of U.S. application Ser. No. 11/301,395, filed on Dec. 13, 2005 entitled "Exercise Weight Stack Methods and Apparatus", which claims the benefit under 35 U.S.C. § 119, (e) to U.S. provisional application No. 60/635,884 entitled "Exercise Weight Stack Methods and Apparatus," filed on Dec. 14, 2004, which are hereby incorporated herein by reference in their entireties.

FIELD OF THE INVENTION

Aspects of the present invention relate to exercise equipment and more particularly, to stacks of weights that may be engaged in different combinations to provide variable resistance to exercise motion.

BACKGROUND

Exercise weight stacks are well known in the art and prevalent in the exercise equipment industry. Generally speaking, a plurality of weights or plates are arranged in a stack and maintained in alignment by guide members or rods. A desired amount of weight is engaged by selectively connecting a selector rod to the appropriate weight in the stack. The selector rod and/or the uppermost weight in the stack are/is connected to at least one force receiving member by means of a connector. The engaged weight is lifted up from the stack in response to movement of the force receiving member.

Some examples of weight stacks, their applications, and/or features are disclosed in U.S. Pat. No. 3,912,261 to Lambert, Sr. (discloses an exercise machine which provides weight stack resistance to a single exercise motion); U.S. Pat. No. 5,263,915 to Habing (discloses an exercise machine which uses a single weight stack to provide resistance to several different exercise motions); U.S. Pat. No. 4,900,018 to Ish III, et al. (discloses an exercise machine which provides weight stack resistance to a variety of exercise motions); U.S. Pat. No. 4,878,663 to Luquette (discloses an exercise machine which has rigid linkage members interconnected between a weight stack and a force receiving member); U.S. Pat. No. 4,601,466 to Lais (discloses bushings which are attached to weight stack plates to facilitate movement along conventional guide rods); U.S. Pat. No. 5,374,229 to Sencil (discloses an alternative to conventional guide rods); U.S. Pat. No. 4,878,662 to Chern (discloses a selector rod arrangement for clamping the selected weights together into a collective mass); U.S. Pat. No. 4,809,973 to Johns (discloses telescoping safety shields which allow insertion of a selector pin but otherwise enclose the weight stack); U.S. Pat. No. 5,000,446 to Sarno (discloses discrete selector pin configurations intended for use on discrete machines); U.S. Pat. No. 4,546,971 to Raasoch (discloses levers operable to remotely select a desired number of weights in a stack); U.S. Pat. No. 5,037,089 to Spagnuolo et al. (discloses a controller operable to automatically adjust weight stack resistance); U.S. Pat. No. 4,411,424 to Barnett (discloses a dual-pronged pin which engages opposite sides of a selector rod); U.S. Pat. No. 1,053,109 to Reach (discloses a stack of weight plates, each having a slide which moves into and out of engagement with the weight plate or top plate above it); and U.S. Pat. No. 5,306,221 to Itaru (discloses a stack of weight plates, each having a lever which pivots into and out of engagement with a selector rod), all of which are incorporated herein by reference.

SUMMARY

Aspects of the subject invention are directed toward improved methods and apparatus for rotating one or more selector rods into engagement with a desired number of weights for purposes of resisting exercise motion. Many of the features and advantages of the present invention will become apparent to those skilled in the art from the more detailed description that follows.

BRIEF DESCRIPTION OF THE DRAWINGS

With reference to the drawings, wherein like numerals represent like parts and assemblies throughout the several views.

DETAILED DESCRIPTION OF EMBODIMENTS

An exercise device conforming to some aspects of the present invention includes one or more weight stacks moveably supported on a frame. Each weight stack includes one or more weight plates that may be selectively engaged by way of a dial arrangement operably coupled with the weight stack.

Some embodiments may be configured with a plurality of weight stacks. In such an arrangement, combinations of weights from each stack may be selected. In one arrangement, discussed in greater detail below, the dial arrangement is connected with a selection member that extends through a selection aperture in the weight plates. Each selection aperture defines a unique contour with at least one engaging surface, such as a tab. The selection member has corresponding protrusion adapted to engage the engaging surface of the weight plate. Each dial arrangement may be configured so that the weight stack may only be actuated when the selection member is properly positioned so that the protrusions properly engage the engaging surfaces. By adjusting the dial setting, the selection member is rotated so that one or more of the various protrusions engage associated engaging surfaces in order to engage some combination of weight plates. A cable or some other coupling member is operably associated with the weight stack and some form of actuation or force receiving member, such as a handle, bar, press arm, and curl bar, arranged for engagement by the user to actuate the weight stack. Upon actuation of the actuation member (i.e., some form of strength training motion), only the selected weights are engaged.

Figure 1:
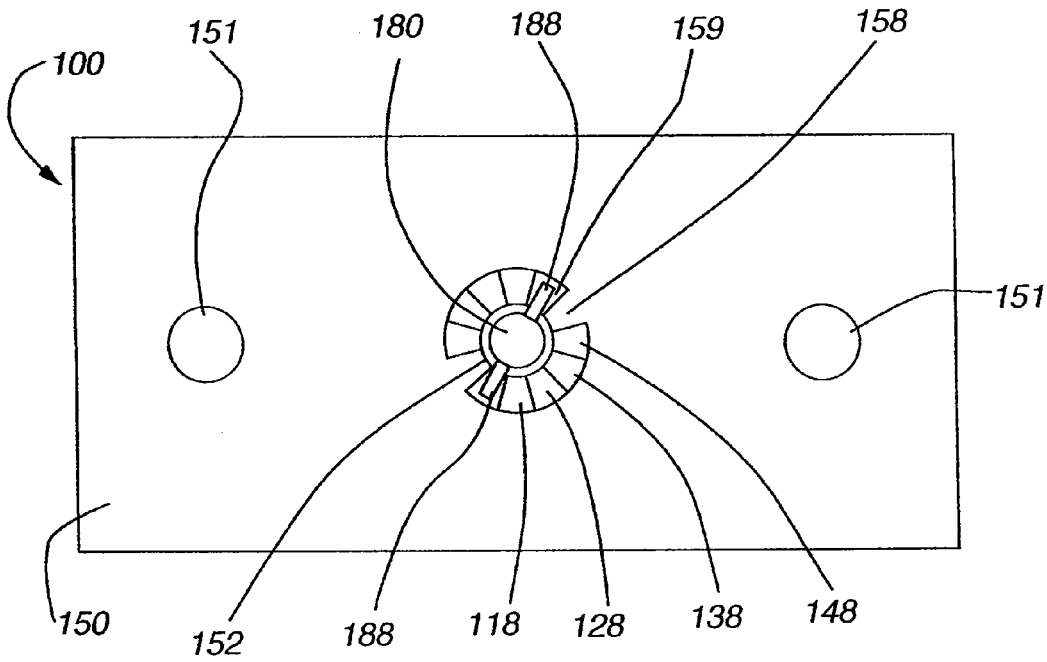
Fig. 1 Prior Art
FIG. 1 is a bottom view of a weight stack.

Referring now to FIG. 1, a bottom view of a weight stack, similar to those disclosed in U.S. Pat. No. 6,186,927 titled "Weight Selection Apparatus" to Krull, which is hereby incorporated by reference herein, is shown. The stack 100 includes a lowermost weight plate 150 disposed beneath four other weight plates. Each weight plate has two diametrically opposed holes 151 to accommodate respective guide rods (not shown), and a central opening 152 to accommodate a selector rod 180. Axially spaced, radially aligned pegs 188 (or other forms of protrusions) project outward from diametrically opposed portions of the selector rod 180 and align with respective weights in the stack 100. The central opening in each weight plate includes diametrically opposed tabs (designated as 158 for the lowermost weight plate 150) or other form of engaging surface, and diametrically opposed notches (designated as 159 for the lowermost weight plate 150), which are disposed between the tabs. The relatively lower weight plates have relatively larger, diametrically opposed notches, which allow the successively higher and larger tabs (designated as 148, 138, 128, and 118, respectively) to be seen from below. The orientation of the selector rod 180 determines how many weights are engaged for resistance to exercise motion. In the configuration shown in FIG. 1, none of the weights are selected, and the selector rod 180 is rotated counter-clockwise in increments of thirty degrees to successively engage the weights (beginning with the uppermost weight).

Figure 2:
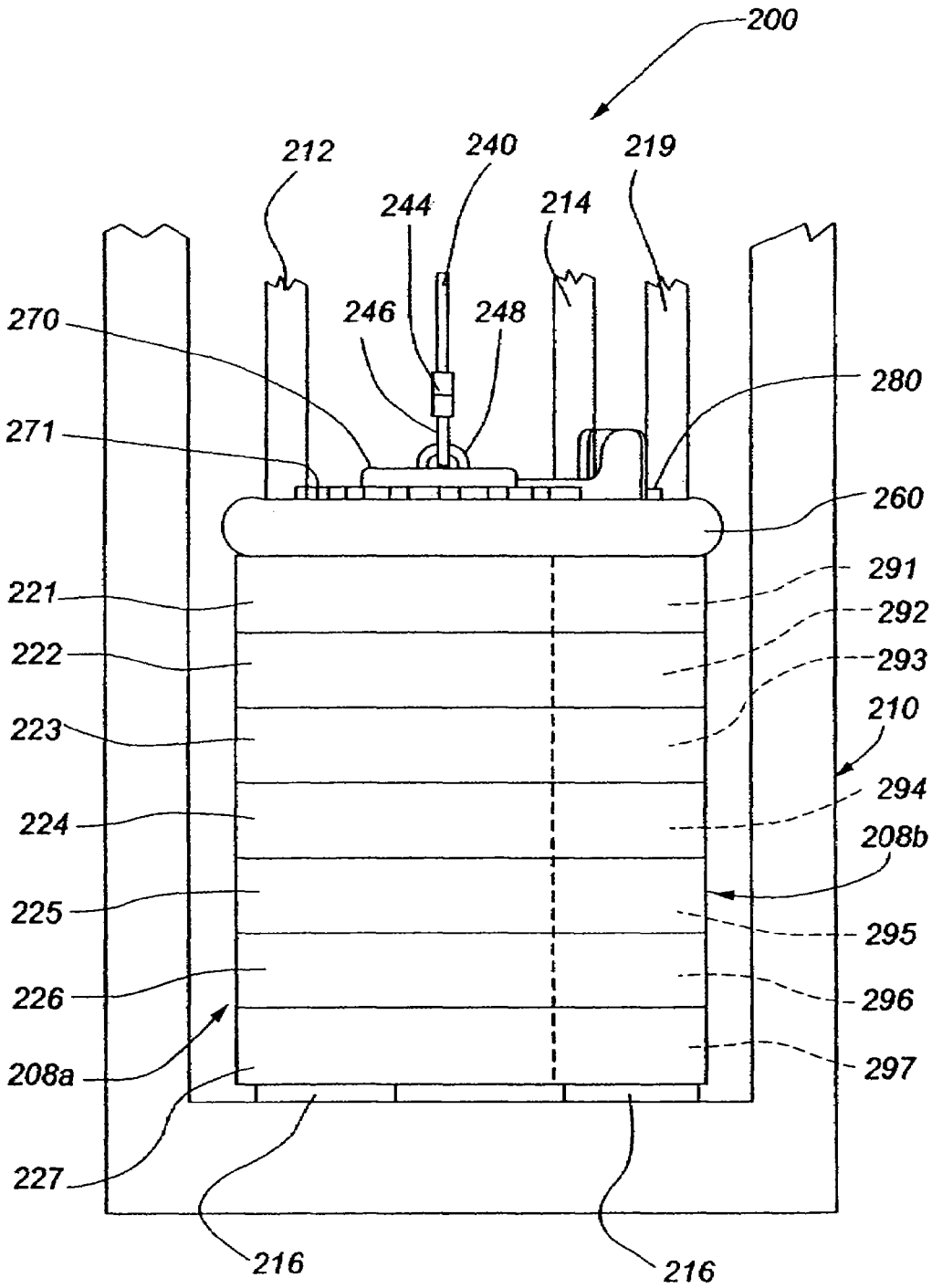
FIG. 2 is a front view of a weight stack machine constructed according to the principles of the present invention.

A first embodiment conforming to aspects of the present invention is shown in FIG. 2, and may be described generally as a weight stack machine 200 having a frame 210 and a plurality of weights arranged into first and second vertical stacks (208*a*, 208*b*) movably supported on the frame 210. Generally, the first vertical stack is configured for gross weight selection while the second vertical stack is configured for fine weight selection. For example, in one particular implementation, the first vertical stack 208*a* includes seven 30-pound weight plates and the second vertical stack 208*b* (shown in dash) includes five 5-pound weight plates. As such, weight combinations of between five (one 5-pound plate) and 235 (seven 30-pound plates plus five 5-pound plates) may be selected. It is possible to construct an exercise device with weight plates having different weights or more or less weight plates in order to achieve different possible weight combinations, increments of weight, and possible maximum weight.

As discussed in greater detail below, the 30 pound weight plates are each configured with a notch so that the second vertical stack may be arranged within the area of the first weight stack. First and second guide rods 212 and 214 are inserted through the first weight stack and secured to the frame 210 to define a path of travel for the first weight stack, and a third guide rod 219 is inserted through the second weight stack and secured to the frame 210 to define a path of travel for the second weight stack. Shock absorbing members or bumpers 216 are mounted on the frame 210 directly beneath the weight stacks.

Figure 4:
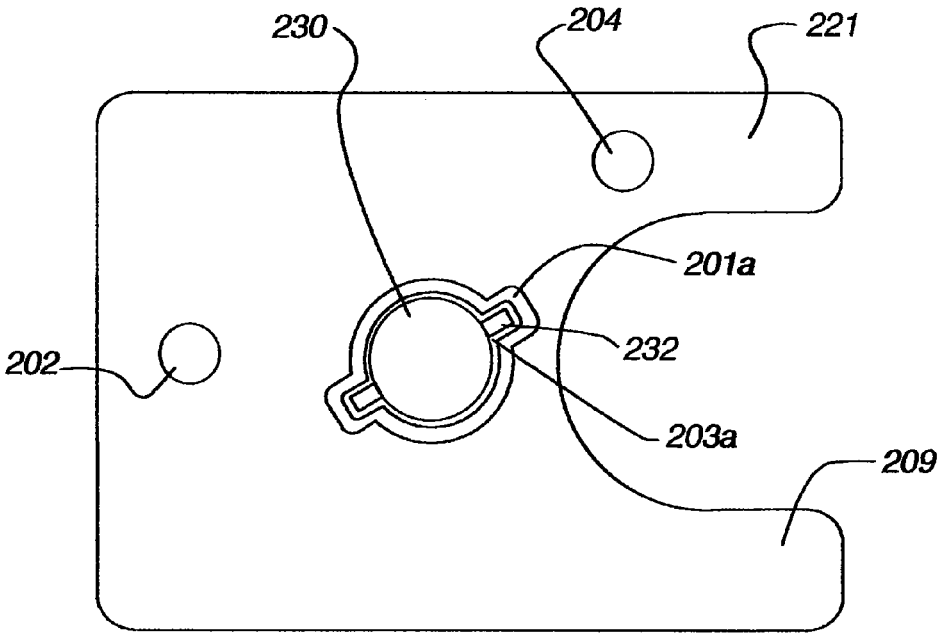
FIG. 4 is a top view of an uppermost primary weight and an associated weight selector on the machine shown in FIG. 2, with the primary weight selector occupying an orientation corresponding to the minimum resistance setting shown in FIG. 3*a;*
Figure 5:
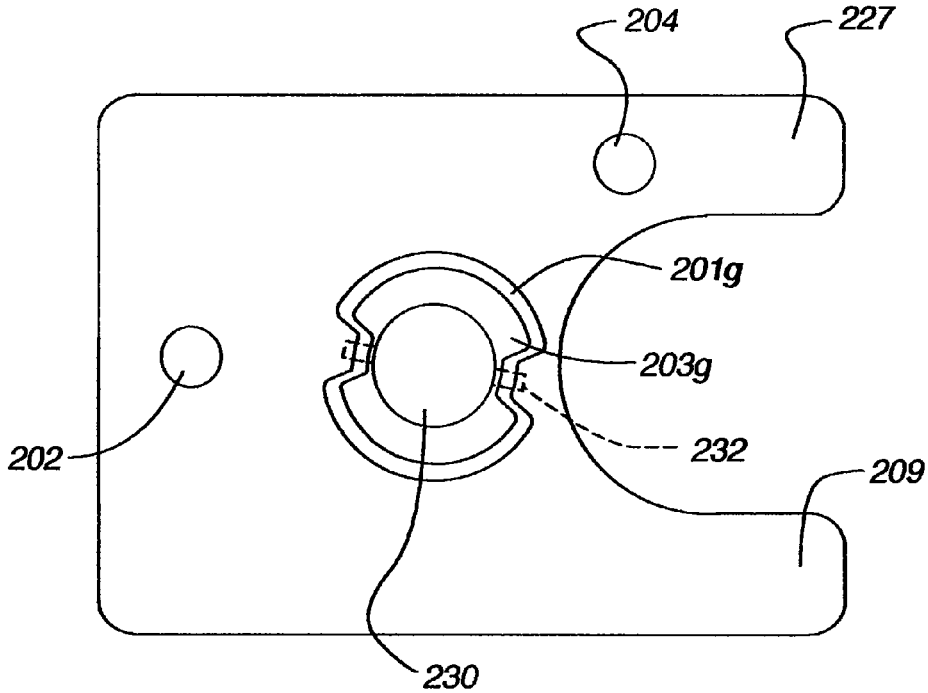
FIG. 5 is a top view a lowermost primary weight and the same primary weight selector on the machine shown in FIG. 2, with the primary weight selector occupying an orientation corresponding to the maximum resistance setting shown in FIG. 3*b;*

The first weight stack, also referred to as the primary weight stack, includes a plurality of 30 pound weights 221-227. FIG. 4 shows the uppermost weight 221 together with a weight selector 230 associated with the first weight stack, and FIG. 5 shows the lowermost weight 227 together with the weight selector 230. The weight selector is discussed in greater detail below with reference to FIGS. 8 and 9. Each of the weights 221-227 is provided with similar holes 202 and 204 to receive the guide rods 212 and 214, and with a similar notch 209 to accommodate the second weight stack within the outer dimensions of the first weight stack, as more fully described below. Each of the weights 221-227 is also provided with its own unique central opening 203 to selectively allow passage of the weight selector 230 depending on the orientation of the weight selector 230. The manner in which the weight selector 230 is rotated to engage the weights 221-227 is described above with reference to FIG. 1.

In one particular configuration, the periphery of the central opening 203*a* in the uppermost weight 221 is beveled or rounded to define a lead-in surface 201*a*. The lead-in surface is provided between the upper surface of the plate 221 and the opening. Similarly, the periphery of the central opening 203*g* in the lowermost weight 227 is beveled or rounded to define a lead-in surface 201*g*. The lead-in surfaces help guide the weight selector 230 downward through any disengaged weights and also provides space for structurally enhanced tabs 232 on the weight selector 230, as more fully described below.

The central openings in the intermediate weights 222-226 gradually change in shape from the opening 203*a* to the opening 203*g*, and have similar lead-in surfaces. The opening 203*a* defines a notch along a portion of the opening and a tab along a significantly larger portion of the opening. Conversely, the opening 203*g* defines a notch along a portion of the opening and tab along a significantly smaller portion of the opening. In the primary weight stack arrangement discussed herein, the selector protrusion 232 engages the tab area of the opening in order to engage a respective weight plate. In an implementation with seven 30 pound weight stacks, there are eight possible orientations of the selector. In one orientation, the selector tab is aligned with the notch portion of the openings in each of the weight plates; thus, no weight plate is engaged. In seven of eight orientations, the selector tab is aligned with the tab portion of the opening 203*a*; thus, the uppermost weight plate is engaged in seven of eight possible selector orientations. In only one of eight possible orientations, the selector tab is aligned with the tab portion of the opening 203*g*; thus, the lowermost weight plate is only engaged in one of eight possible selector orientations. The weight plates 222 through 226 are arranged with an opening having different configurations such that between one and all seven plates may be engaged by the selector. For example, the second to last weight plate 226 has an opening with tabs and notches arranged such that the selector protrusion engages the weight plate in two of eight orientations (either six or all seven plates), the third to last weight plate has an opening with tabs an notches arranged such that the selector protrusion engages the weight plate in three of eight orientations (five, six, or all seven plates) and so on.

Figure 6:
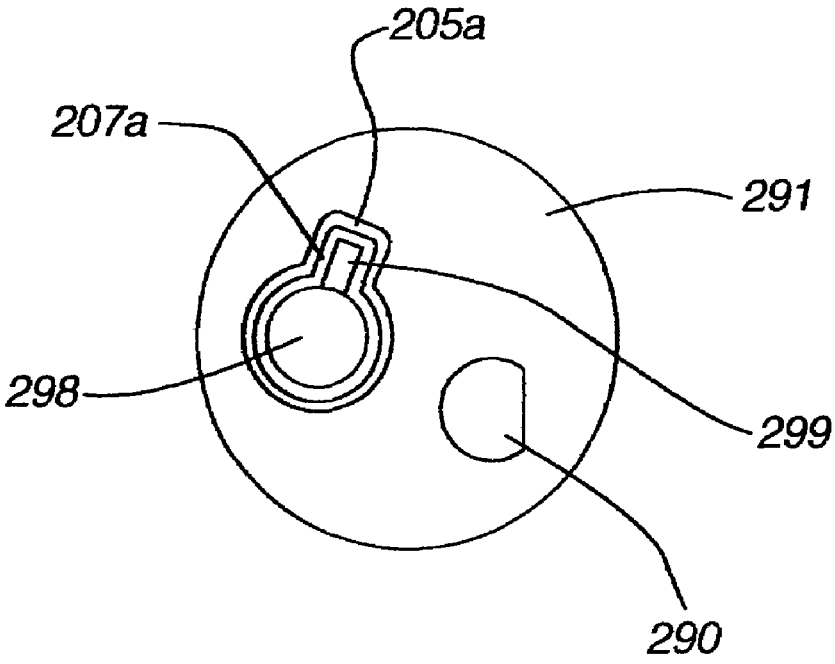
FIG. 6 is a top view of an uppermost secondary weight and associated weight selector on the machine shown in FIG. 2, with the secondary weight selector occupying an orientation corresponding to the minimum resistance setting shown in FIG. 3*a;*
Figure 7:
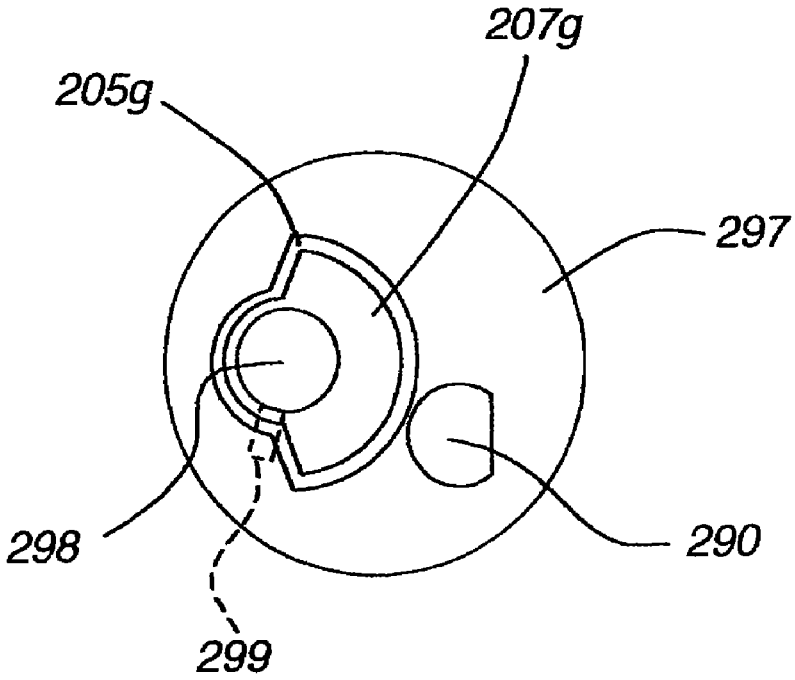
FIG. 7 is a top view a lowermost, small weight and the same secondary weight selector on the machine shown in FIG. 2, with the secondary weight selector occupying an orientation corresponding to the maximum resistance setting shown in FIG. 3*b;*

The second weight stack, also referred to as the secondary weight stack, includes a plurality of five pound weights 291-297. FIG. 6 shows the uppermost weight 291 together with a weight selector 298 associated with the second weight stack, and FIG. 7 shows the lowermost weight 297 together with the weight selector 298. Each of the weights 291-297 is configured to nest inside the notches 209 in the weights 221-227 of the primary vertical stack, and provided with a hole 290 to receive the guide rod 219. Each of the weights 291-297 is also provided with its own unique central opening to selectively allow passage of the weight selector 298 depending on the orientation of the weight selector and the protrusion 299. Again, the manner in which the weight selector 298 rotates to engage the weights 291-297 is described above with reference to FIG. 1.

In one particular implementation, the periphery of central opening 207*a* in the uppermost weight 291 is beveled or rounded to define a lead-in surface 205*a*. The lead-in surface is provided between the upper surface of the plate 221 and the opening. Similarly, the periphery of the central opening 207*g* in the lowermost weight 297 is beveled or rounded to define a lead-in surface 205*g*. The lead-in surfaces help guide the weight selector 298 downward through any disengaged weights and also provide space for structurally enhanced tabs 299 on the weight selector 298 (similar to those on the weight selector 230).

The central openings in the intermediate weights 292-296 gradually change in shape from the opening 207*a* to the opening 207*g*, and have similar lead-in surfaces. Similar to the opening of the primary weight stack plates, the openings in the secondary weight plates are arranged such that the selector rod may be oriented to engage different combinations of weight plates. The opening 207*a* defines a notch along a portion of the opening and a tab along a significantly larger portion of the opening. The opening 207*a* resembles a keyhole. Conversely, the opening 207*g* defines a notch along a portion of the opening and tab along a smaller portion of the opening. In the secondary weight stack arrangement discussed herein, the selector protrusion 299 engages the tab area of the opening in order to engage a respective weight plate. In an implementation with five pound weight stacks, there are six possible orientations of the selector. In one orientation, the selector tab is aligned with the notch portion of all of the openings in each of the weight plates; thus, no weight plate is engaged. In five of six orientations, the selector tab is aligned with the tab portion of the opening 207*a;* thus, the uppermost weight plate is engaged in five of six possible selector orientations. In only one of six possible orientations, the selector tab is aligned with the tab portion of the opening 207*g;* thus, the lowermost weight plate is only engaged in one of six possible selector orientations. The weight plates 292 through 296 are arranged with openings having different configurations such that between one and all five plates may be engaged by the selector. For example, the second to last weight plate 296 has an opening with tabs and notch arranged such that the selector protrusion engages the weight plate in two of six orientations (either four or all five plates), the third to last weight plate has an opening with tabs and notches arranged such that the selector protrusion engages the weight plate in three of five orientations (three, four, or all five plates) and so on.

Figure 8:
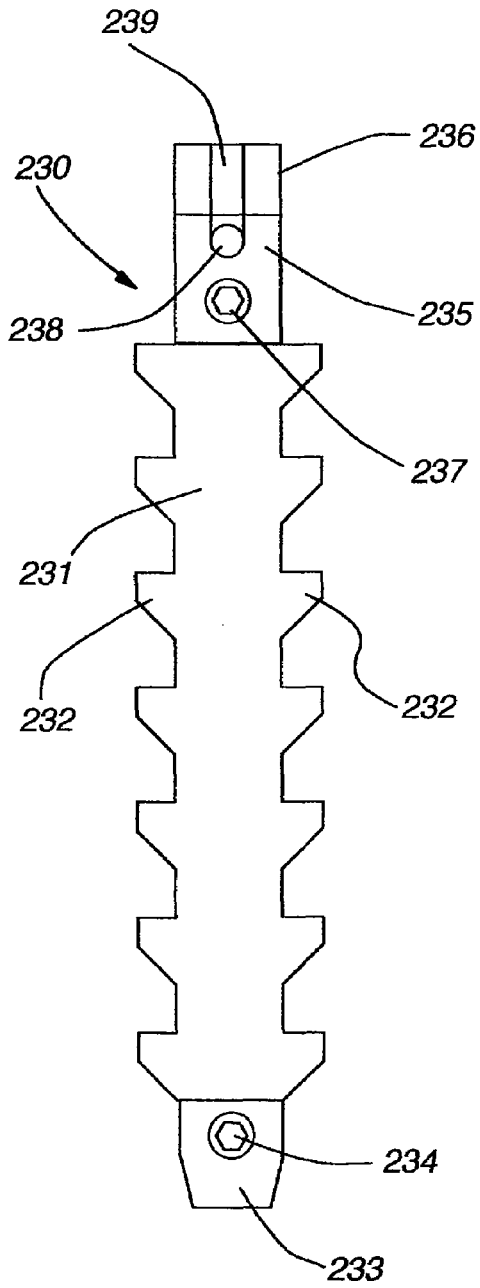
FIG. 8 is a front view of the primary weight selector.
Figure 9:
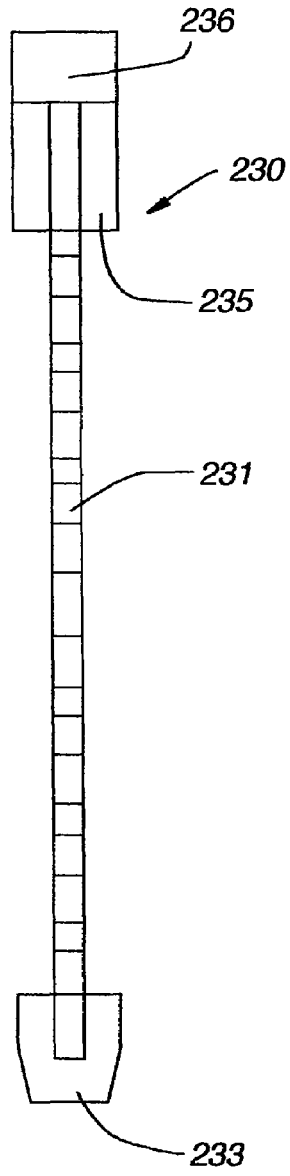
FIG. 9 is a side view of the primary weight selector.

As shown in FIGS. 8-9, the weight selector 230 may be described in terms of a strip or sheet (or multiple strips or sheets) of material (preferably steel) that has been cut or otherwise fabricated into the configuration shown in FIG. 8. Tabs or protrusions 232 extend outward from opposite sides of the strip 231 at locations that align with cavities formed in the bottom of respective weights 221-227. The protrusions have a top surface substantially perpendicular to the longitudinal axis of the selector and are an angled bottom surface. The lead-in surfaces on the weights 221-227 cooperate with the angled surfaces to allow the protrusions 232 to more smoothly rotate within the apertures. A leading tip or plug 233 (preferably made of plastic) is secured to the lower end of the strip 231 by a bolt or other suitable fastener 234. A base or plug (also preferably made of plastic) is similarly secured to the upper end of the strip 231 by a bolt or other suitable fastener 237. The upper plug includes a first portion 235 that is configured to be rotatably connected to a top plate 260 (see FIG. 1), and a second portion 236 that is configured to be rigidly connected to a user operated member or knob 270 (discussed further below with reference to FIGS. 3*a* and 3*b*). The other weight selector 298 may be formed in similar fashion (but with a single set of protrusions 299) or alternatively, in accordance with the Krull patent already incorporated herein by reference. As such, when the first selection rod is pulled upward during training, it pulls the plate and the second vertical stack selector rod upward.

Figure 3A:
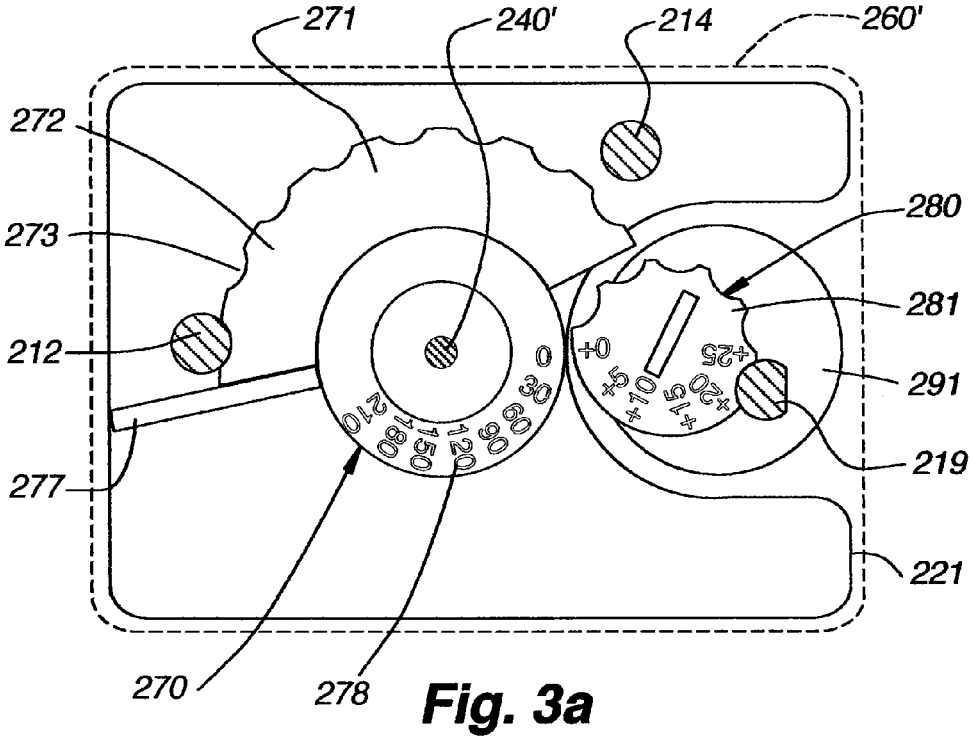
FIG. 3*a* is a top view of a portion of the machine shown in FIG. 2, with the machine set to provide minimum resistance to exercise motion.
Figure 3B:
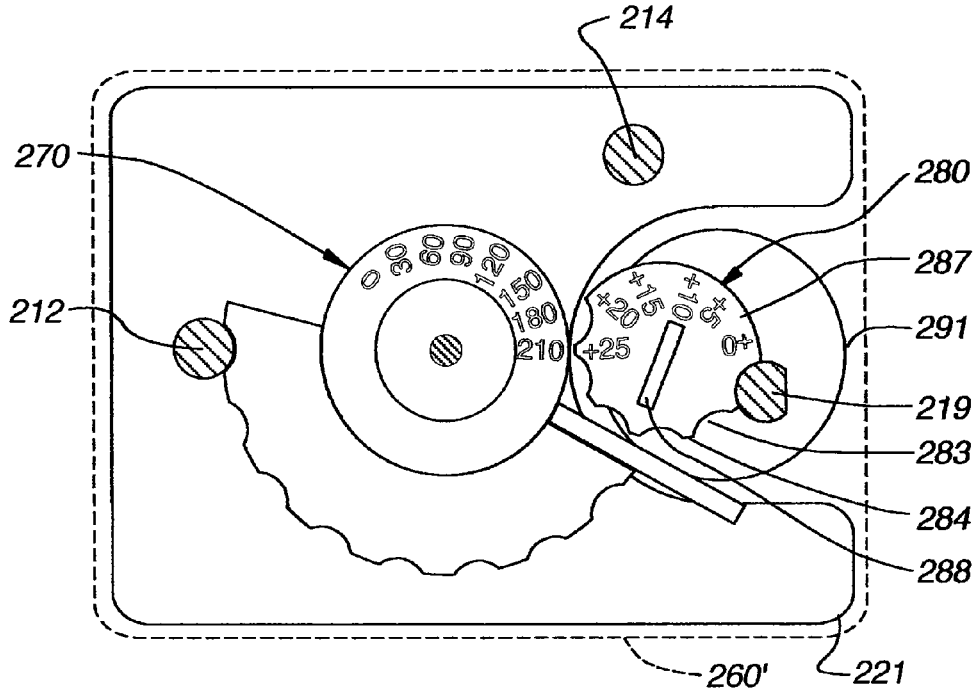
FIG. 3*b* is a top view of the same machine portion that is shown in FIG. 3*a,* but with the machine set to provide maximum resistance to exercise motion.

Referring now to FIGS. 3*a* and 3*b*, the user operated member 270 a dial is rotatably mounted on the top plate 260, the upper surface of which is shown in dashed lines and designated as 260'. The user operated member 270 includes a dial portion 278 that bears weight amounts in increments of thirty pounds, a plate portion 271 having a scalloped perimeter, and a lever or handle portion 277. Generally, the plate portion defines an arcuate periphery with a contour, such as scalloping, saw tooth, etc., adapted to receive the guide post to orient the selector member properly in the weight plates. The handle portion 277 moves counterclockwise from the position shown in FIG. 3*a* to the position shown in FIG. 3*b* to adjust the engaged weight from zero to two hundred and ten pounds (in increments of thirty pounds). In a two stack embodiment, at each weight engaging orientation of the user operated member 270, a weight amount on the dial portion 278 aligns with a weight amount on an adjacent knob 280 (further described below) to indicate the amount of weight that is engaged.

The plate portion 271 has circumferentially spaced, peripheral notches 273 defined between tabs 272. A slot or groove is cut into the guide rod 212 to admit passage of the tabs 272 when the top plate 260 occupies a rest position on the frame 210. In one particular arrangement, in order to free the top plate 260 for upward movement from the rest position, one of the notches 273 is aligned with the guide rod 212. A spring detent arrangement (not shown on this embodiment but described with reference to FIG. 13) may be provided to bias the user operated member 270 toward orientations where guide rod 212 aligns with respective notches 273. Once the top plate 260 is moved upward from its rest position, the guide rod 212 cooperates with the aligned notch 273 to prevent rotation of the user operated member 270.

The user operated member or knob 280 is also rotatably mounted on the top plate 260. The user operated member 280 similarly includes a dial portion 287 that bears weight amounts in increments of five pounds, a plate portion 281 having a scalloped or other contoured perimeter, and a handle portion 288. The handle portion 288 moves from the position shown in FIG. 3*a* to the position shown in FIG. 3*b* to adjust the engaged weight from zero to twenty-five pounds (in increments of five pounds). At each weight engaging orientation of the user operated member 280, a weight amount on the dial portion 287 aligns with a weight amount on the adjacent knob 270 to indicate the amount of weight that is engaged.

The plate portion 281 has circumferentially spaced, peripheral notches 283 defined between tabs 284. A slot or groove is cut into the guide rod 219 to admit passage of the tabs 284 when the top plate 260 occupies a rest position on the frame 210. In one particular arrangement, in order to free the top plate 260 for upward movement from the rest position, one of the notches 283 is aligned with the guide rod 219. A spring detent arrangement (not shown on this embodiment, but described with reference to FIG. 13) may be provided to bias the user operated member 280 toward orientations where guide rod 219 aligns with respective notches 283. Once the top plate 260 is moved upward from its rest position, the guide rod 219 cooperates with the aligned notch 283 to prevent rotation of the user operated member 280.

To actuate the primary and secondary stacks, a cable is connected with the selection member. The other end of the cable is coupled with a force actuation member hole, one or more cables may be employed depending on a particular exercise device arrangement. As shown in FIG. 8, a hole 238 is formed through the strip 231 and the upper plug portion 235, and diametrically opposed grooves or channels 239 extend upward from the hole 238 to the upper end of the upper plug portion 236. An elliptical-shaped steel ring 248 (shown in FIG. 2) is inserted through the hole 238 and nested inside the grooves 239. As also shown in FIG. 2, the ring 248 is also inserted through another looped member 246, thereby linking the looped member 246 to the weight selector 230. A swivel connector or other suitable fastener 244 is interconnected between the looped member 246 and a cable 240 that in turn, is connected to a force receiving member (not shown). A cross-section of the cable 240 is designated as 240' and shown relative to a central opening in the dial portion 278 of the user operated member 270 in FIGS. 3*a*-3*b*. As mentioned above, both the first and second selection members are coupled with the top plate; thus, upward movement to the first selection is accompanied by upward movement of the second selection and whatever plates are selected in the second stack.

Figure 11:
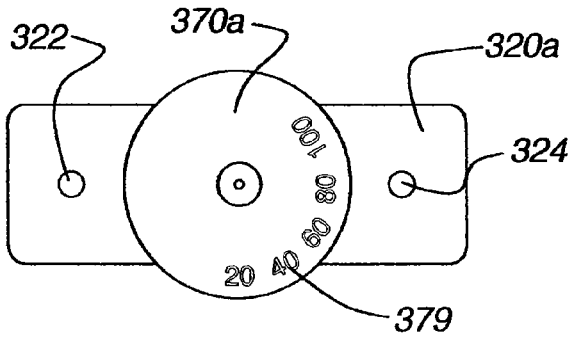
FIG. 11 is a top view of a portion of the weight stack machine shown in FIG. 10, with the top plate removed from the weight stack.
Figure 10:
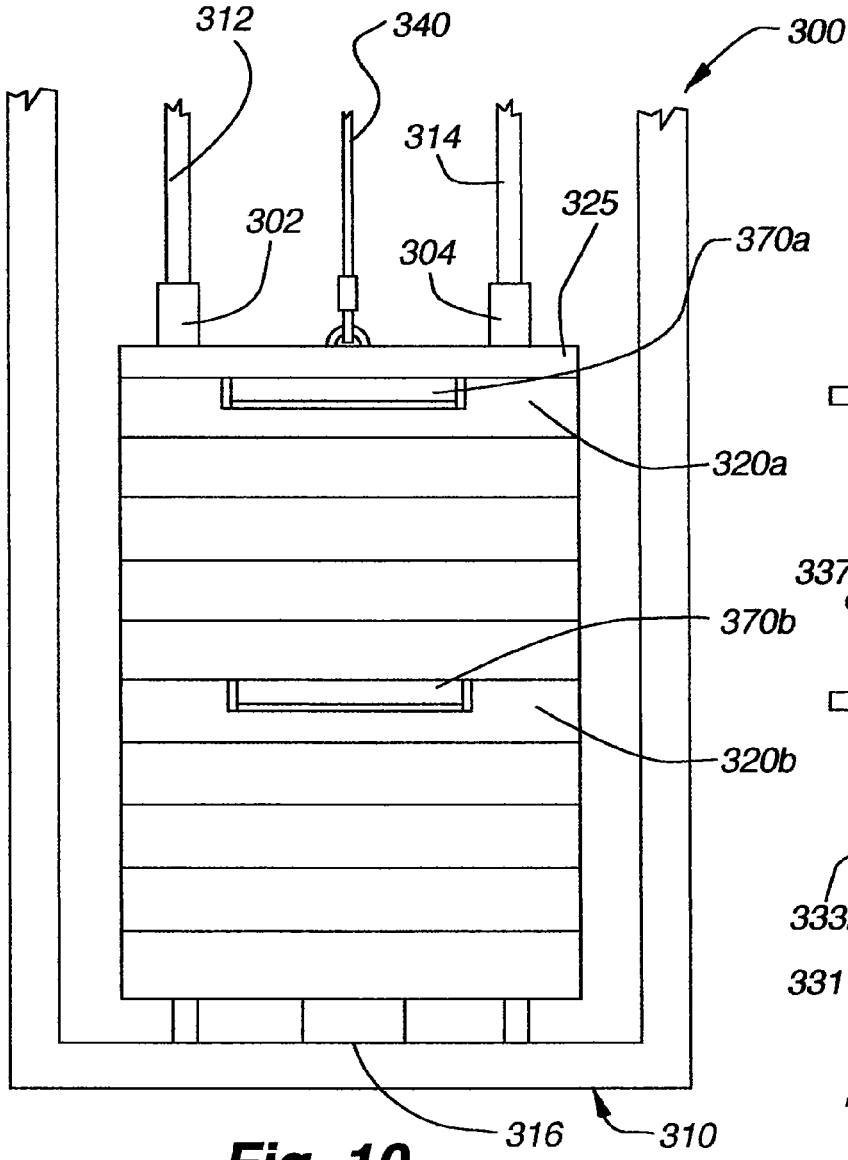
FIG. 10 is a front view of another weight stack machine constructed according to the principles of the present invention.
Figure 12:
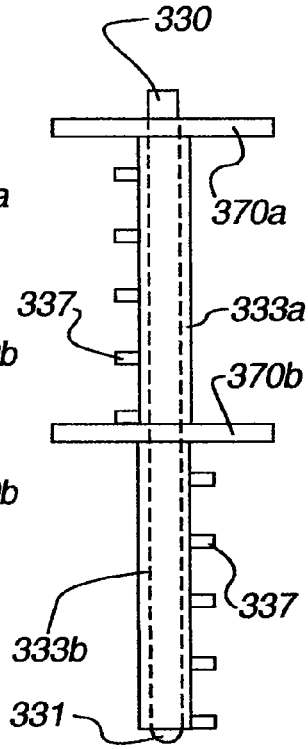
FIG. 12 is a front view of a multiple piece weight selector on the weight stack machine of FIG. 10.

Another exercise device conforming to aspects of the present invention is shown in FIGS. 10-12, and may be described generally as a weight stack machine 300 having a frame 310 and a plurality of weights arranged into a vertical stack movably mounted on the frame 310. The exercise device illustrated in FIGS. 10-12 includes a first weight stack and a second weight stack. However, unlike the first embodiment where the first stack is arranged adjacent the second stack in parallel vertical columns, the first weight stack is arranged adjacent the second stack in a single vertical column with one stack above the other stack.

Referring now in more detail to FIGS. 10-12, first and second guide rods 312 and 314 are inserted through respective holes 322 and 324 in the weight plates, as well as a top plate 325. The guide rods are secured to the frame 310 to define a path of travel for the weights. A shock absorbing member or bumper 316 is mounted on the frame 310 directly beneath the weights. As with the first embodiment, a cable 340 is interconnected between the top plate 325 and a force receiving member (not shown). Also, in order to better maintain a desired top plate orientation, bushings 302 and 304 are preferably mounted on respective guide rods 312 and 314 and secured to the top plate 325 (and similar bushings may be provided on other embodiments, if desired).

A shaft 330 has an upper end that is secured to the top plate 325, and an opposite, lower end 331 that is tapered. As shown in FIG. 12, a first, upper selector 333*a* is rotatably mounted on an upper portion of the shaft 330, and a second, lower selector 333*b* is rotatably mounted on a lower portion of the shaft 330. In one implementation, each selector 333*a* and 333*b* includes a cylindrical steel tube having tabs or pegs 337 extending radially outward from a side of the tube at axially spaced locations. The pegs 337 rotate into engagement with respective weights on the machine 300 in a manner described above with reference to FIG. 1. However, the selectors 333*a* and 333*b* are rotatable independent of one another, thereby allowing the same sector of space to be used twice. In other words, for holes through the weights of a given diameter, there is only a limited amount of circumferential space to accommodate weight selector pegs, and therefore, only a finite number of selector orientations that can be accommodated. The provision of two separately rotatable selectors 333*a* and 333*b* makes each orientation available to select two different amounts of weight (one including some combination of the upper weights, and the other including all of the upper weights and some combination of the lower weights).

Plates or discs 370*a* and 370*a* are nested within respective weights 320*a* and 320*b*, and are rigidly secured to respective selectors 333*a* and 333*b*. The plates 370*a* and 370*b* may be used to facilitate selective rotation of the selectors 333*a* and 333*b*, respectively. Thus, rotation of the plates causes engagement between one or more of the tabs 337 and a respective weight 320. Additionally, the plates include indicia 379 indicating the orientations of the selectors 333*a* and 333*b*. Further, the plates 370*a*, 370*b* may be arranged to maintain proper axial spacing of the selectors 333*a* and 333*b* relative to the shaft 330.

Referring to FIG. 11, the plate 370*a* is rotated to adjust resistance between twenty and one hundred pounds. The plate 370*b* is also rotated to adjust resistance between one hundred twenty and two hundred pounds.

Figure 13:
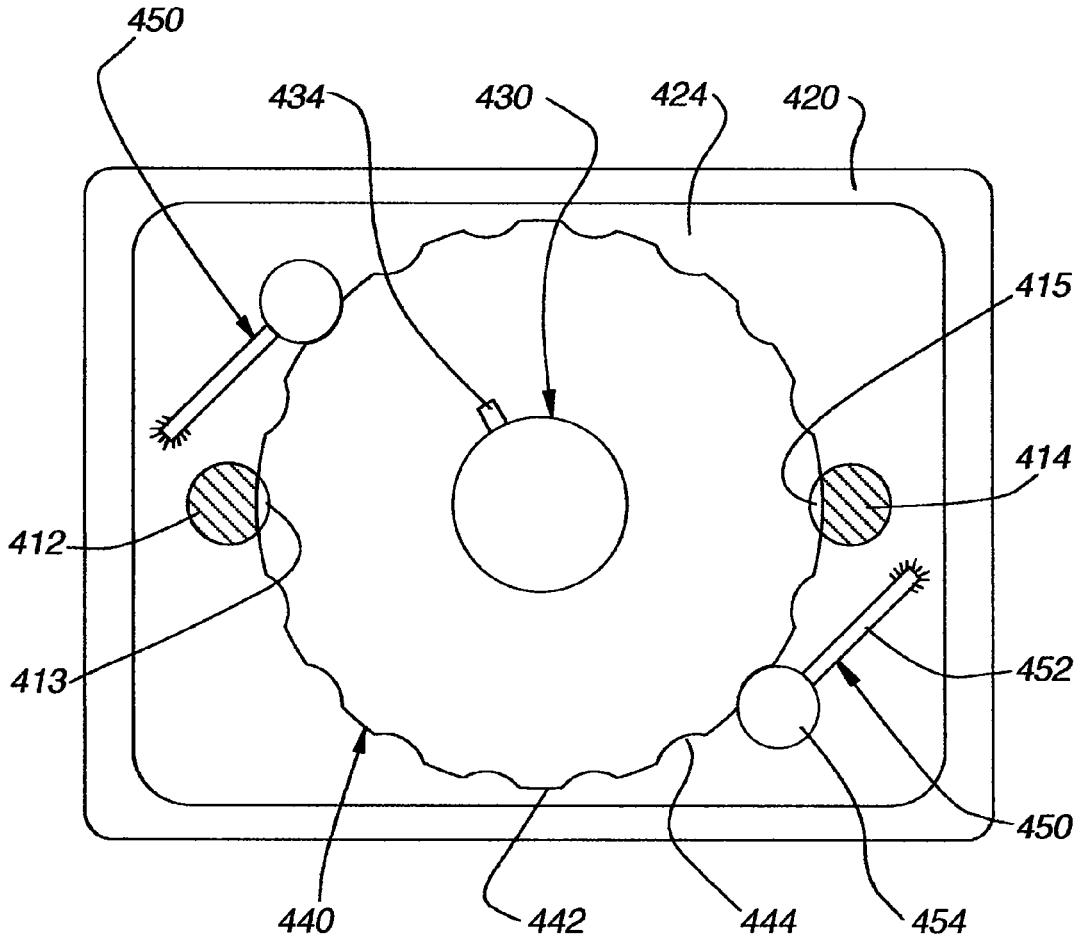
FIG. 13 is a bottom view of a latching arrangement suitable for use on the weight stack machine of FIG. 10.

FIG. 13 shows a latching arrangement similar to that discussed above with reference to the embodiment 200, and suitable for use on various embodiments of the present invention, including the embodiment of FIGS. 2-9 and the embodiments of FIGS. 10-12. The underside or bottom of a plate 420 is shown with a cavity 424 formed therein to accommodate both the latching arrangement and a biasing arrangement. A weight selector 430 having axially spaced tabs 434 is rotatably mounted to the plate 420, and operates in a manner described above with reference to other embodiments.

A plate or disc 440 is rigidly secured to the weight selector 430 for rotation together therewith. The plate 440 has circumferentially spaced, peripheral notches 444 defined between tabs 442. Slots or grooves 413 and 415 are cut into respective guide rods 412 and 414 to admit passage of the tabs 442 when the plate 420 occupies a lowermost, rest position. In order to free the plate 420 for upward movement from the rest position, diametrically opposed notches 444 must be aligned with the guide rods 412 and 414 (as shown in FIG. 13). Once the plate 420 is moved upward from its rest position, the guide rods 412 and 414 cooperate with respective aligned notches 444 to prevent rotation of the plate 440 and the weight selector 430. When embodied on the machine 300 described above, this arrangement places grooves in the guide rods 312 and 314 at locations disposed beneath the bushings 302 and 304, thereby eliminating any risk that the grooves will damage or hinder operation of the bushings 302 and 304.

FIG. 13 also shows spring detent arrangements 450 that bias the plate 440 toward the orientation shown in FIG. 13, and toward other orientations wherein the guide rods 412 and 414 are aligned with respective notches 444. Each arrangement 450 includes a leaf spring 452 having a first end secured to the plate 420, and an opposite, second end secured to a respective head 454 that is configured to occupy any of the notches 444. The springs 452 bias the heads 454 to remain in the aligned notches 444, and to bear against the edge of the plate 440 when the plate 440 is rotated.

To the extent that embodiments of the present invention use weights in two discrete stacks, the weights in the secondary stack may facilitate fractional adjustments relative to the weights in the primary stack, thereby providing relatively more weight settings for a giving number of weights.

To the extent that the present invention uses rotation of the weight selector(s) relative to the weights to selectively engage and disengage the weights, the selection process can be automated or motorized with relatively few additional parts. In this regard, one or more motors can be used to perform the rotation in response to user-entered data and/or a signal from a controller. In such a scenario, information indicating a desired amount of weight or a desired change in weight may be entered via a keypad, a machine readable card, a voice recognition device, a switch on a force receiving member, or any other suitable means.

When a specific weight amount is sought, a controller compares the desired amount of weight to the currently selected amount of weight. If the two values are equal (or within the minimum available adjustment of one another), then the controller simply indicates that the desired amount of weight is engaged. Otherwise, the controller divides the desired amount of weight by the larger weight increment to obtain a quotient. The controller then rounds down the quotient to obtain a first integer value and determines whether the relevant selector should be rotated. If so, then the controller causes the motor to rotate the relevant selector into engagement with the appropriate number of larger weights. Thereafter, the controller subtracts the first integer value from the quotient to obtain a remainder and divides the remainder by the smaller weight increment (five). The controller then rounds off to obtain a second integer value and determines whether the relevant selector should be moved. If so, then the controller causes the motor to rotate the relevant selector into engagement with the appropriate number of smaller weights. After any and all adjustments have been made, the controller indicates that the desired amount of weight is engaged.

Although various representative embodiments of this invention have been described above with a certain degree of particularity, those skilled in the art could make numerous alterations to the disclosed embodiments without departing from the spirit or scope of the inventive subject matter set forth in the specification and claims. All directional references (e.g., upper, lower, upward, downward, left, right, leftward, rightward, top, bottom, above, below, vertical, horizontal, clockwise, and counterclockwise) are only used for identification purposes to aid the reader's understanding of the embodiments of the present invention, and do not create limitations, particularly as to the position, orientation, or use of the invention. Joinder references (e.g., attached, coupled, connected, and the like) are to be construed broadly and may include intermediate members between a connection of elements and relative movement between elements. As such, joinder references do not necessarily infer that two elements are directly connected and in fixed relation to each other.

In some instances, components are described with reference to "ends" having a particular characteristic and/or being connected to another part. However, those skilled in the art will recognize that the present invention is not limited to components which terminate immediately beyond their points of connection with other parts. Thus, the term "end" should be interpreted broadly, in a manner that includes areas adjacent, rearward, forward of, or otherwise near the terminus of a particular element, link, component, member or the like. In methodologies directly or indirectly set forth herein, various steps and operations are described in one possible order of operation, but those skilled in the art will recognize that steps and operations may be rearranged, replaced, or eliminated without necessarily departing from the spirit and scope of the present invention. It is intended that all matter contained in the above description or shown in the accompanying drawings shall be interpreted as illustrative only and not limiting. Changes in detail or structure may be made without departing from the spirit of the invention as defined in the appended claims.

I claim:

1. An exercise apparatus, comprising:

a frame;

a stack of weights, including a top plate, movably mounted on the frame;

a weight selector rotatably mounted on the top plate and selectively rotatable into engagement with at least one of the weights; and a member operably associated with the weight selector and located above the top plate, wherein the member prevents the weight selector from rotating unless the top plate occupies a rest position relative to the frame.

2. The exercise apparatus of claim 1, wherein the member prevents the stack from moving from a stack rest position relative to the frame unless the weight selector occupies at least one desired orientation relative to the top plate.

3. The exercise apparatus of claim 2, wherein:

the frame includes a post; and selective engagement of the member with the post prevents the top plate from moving from the top plate rest position.

4. The exercise apparatus of claim 2, further comprising a detent arrangement operatively associated with the weight selector to bias the weight selector to at least one of the at least one desired orientations relative to the stack.

5. The exercise apparatus of claim 1, wherein at least a portion of a periphery of the member is scalloped.

6. The exercise apparatus of claim 1, wherein the member includes at least one notch.

7. The exercise apparatus of claim 1, wherein the member includes at least one tab.

8. The exercise apparatus of claim 1, wherein:

the frame includes a post; and selective engagement of the member with the post prevents rotation of the weight selector.

9. An exercise apparatus, comprising:

a frame including a post;

a stack of weights, including a top plate, movably mounted on the frame;

a weight selector rotatably mounted on the top plate and selectively rotatable into engagement with at least one of the weights;

a member operably associated with the weight selector and located above the top plate, wherein the member prevents the weight selector from rotating unless the top plate occupies a rest position relative to the frame; and selective engagement of the member with the post prevents rotation of the weight selector;

wherein the post is received in at least one aperture defined in at least one weight in the stack of weights.

10. An exercise apparatus, comprising:

a frame including a post;

a stack of weights, including a top plate, movably mounted on the frame;

a weight selector rotatably mounted on the top plate and selectively rotatable into engagement with at least one of the weights;

a member operably associated with the weight selector and located above the top plate, wherein the member prevents the weight selector from rotating unless the top plate occupies a rest position relative to the frame; and selective engagement of the member with the post prevents rotation of the weight selector; wherein:

the member includes at least one tab; and the post includes at least one slot for selectively receiving the at least one tab.

11. An exercise apparatus, comprising:

a frame;

a stack of weights, including a top plate, movably mounted on the frame;

a weight selector rotatably mounted on the top plate and selectively rotatable into engagement with at least one of the weights; and a member operably associated with the weight selector and located above the top plate, wherein the member locks the top plate against movement relative to the frame when the top plate occupies a rest position unless the weight selector occupies at least one desired orientation relative to the stack.

12. The exercise apparatus of claim 11, wherein at least a portion of a periphery of the member is scalloped.

13. The exercise apparatus of claim 11, wherein the member includes at least one notch.

14. The exercise apparatus of claim 11, wherein the member includes at least one tab.

15. The exercise apparatus of claim 11, wherein:

the frame includes a post; and selective engagement of the member with the post prevents the top plate from moving from the top plate rest position.

16. The exercise apparatus of claim 11, further comprising a detent arrangement operatively associated with the weight selector to bias the weight selector to at least one of the at least one desired orientations relative to the stack.

17. An exercise apparatus, comprising:

a frame including a post;

a stack of weights, including a top plate, movably mounted on the frame;

a weight selector rotatably mounted on the top plate and selectively rotatable into engagement with at least one of the weights;

a member operably associated with the weight selector and located above the top plate, wherein the member locks the stack against movement from a rest position relative to the frame unless the weight selector occupies at least one desired orientation relative to the top plate; and selective engagement of the member with the post prevents the stack from moving from the stack rest position;

wherein the post is received in at least one aperture defined in at least one weight in the stack of weights.

18. An exercise apparatus, comprising:

a frame including a post;

a stack of weights, including a top plate, movably mounted on the frame;

a weight selector rotatably mounted on the top plate and selectively rotatable into engagement with at least one of the weights;

a member operably associated with the weight selector and located above the top plate, wherein the member locks the stack against movement from a rest position relative to the frame unless the weight selector occupies at least one desired orientation relative to the top plate; and selective engagement of the member with the post prevents the stack from moving from the stack rest position; wherein:

the member includes at least one tab; and the post includes at least one slot for selectively receiving the at least one tab.

* * * * *